United States Patent [19]

Jaakonmäki et al.

[11] Patent Number: 4,492,343

[45] Date of Patent: Jan. 8, 1985

[54] WOOD CHIP SHAVING MACHINE

[75] Inventors: Matti Jaakonmäki; Pentti Raura, both of Valko, Finland

[73] Assignee: Rauma-Repola Oy, Finland

[21] Appl. No.: 456,742

[22] Filed: Jan. 10, 1983

[30] Foreign Application Priority Data

Jan. 28, 1982 [FI] Finland ..... 820285

[51] Int. Cl.[3] ..... B02C 13/16

[52] U.S. Cl. ..... 241/95; 144/162 R; 241/48; 241/275

[58] Field of Search ..... 241/47, 48, 95, 135, 241/136, 146, 151, 275, 292.1; 144/162 R, 163

[56] References Cited

U.S. PATENT DOCUMENTS 3,738,596 6/1973 Miles ..... 241/95

3,807,644 4/1974 Van Ee ..... 241/95

3,823,880 7/1974 Urschel ..... 241/95

*Primary Examiner*—W. D. Bray

[57] ABSTRACT

A shaver for wood chips, consisting of a rotor provided with a chip guide plate and circumferential blades placed on its outside, in connection of which there is an annular interspace for the shavings cut from the chips, wherefrom the shavings further depart through a discharge aperture communicating with the interspace. At least one air passage is provided on the margin of the interspace and in the chip guide plate, through which the air flow created by the rotor can rejoin the circulation in the shaver. With the aid of the invention the air flow created by the rotor can be included in the internal circulation in the shaver and no large objectionable quantities of air depart from the shaver.

4 Claims, 1 Drawing Figure

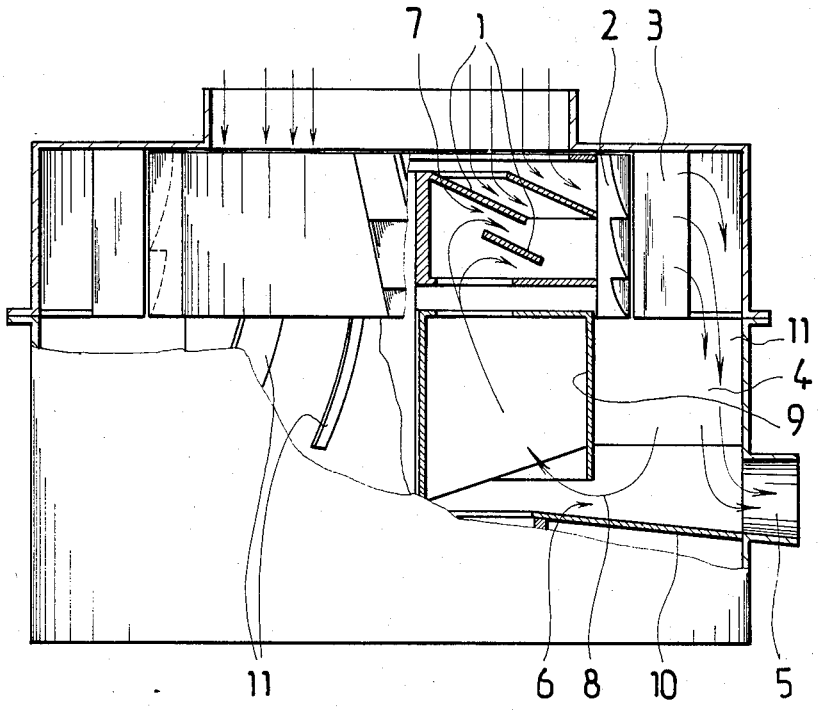
7
1
2
3
11
4
9
11
6
8
10
5

WOOD CHIP SHAVING MACHINE

The present invention concerns a shaver for wood chips, consisting of a rotor provided with a chip guide plate and of circumferential blades on the outside thereof, in connection of which there is an annular interspace for the shavings cut from the chips, wherefrom the shavings further depart through a discharge aperture communicating with the interspace.

All shavers of this type present the drawback that the rotor creates a very powerful air flow after the discharge aperture. This large amount of air must be removed in one way or another and purified from dust for instance with blowers and a cyclone. This extra equipment requires both space and energy. The air flow is admittedly necessary from the viewpoint of the internal functioning of the machine, and therefore endeavours are made to direct most of it into the internal circulation of the machine.

The object of the present invention is to eliminate the drawbacks mentioned above. The shaver of the invention is characterized in that there is at least one air passage on the margin of the interspace and in the chip guide plate, through which the air flow produced by the rotor can return into circulation in the shaver. By the aid of the invention, the air flow created by the rotor joins the internal circulation of the shaver, and it is no longer necessary to eliminate great amounts of air by means of large blowers and a cyclone. It is self-evident that some air will escape with the shavings coming from the shaver, but this quantity of air is negligible compared with the air quantities emerging from shavers of prior art.

One advantageous embodiment of the invention is characterized in that the air passage in the interspace is formed by the gap between the inner wall of the interspace and the chip shavings expeller plate. The gap formed in this manner implies no extra structures, and owing to the centrifugal force of the expeller plate no shavings can enter the gap.

Another embodiment of the invention is characterized in that the air passage of the rotor consists of the gap between two stepwise superposed chip guide plates. A gap like this is simple and structurally advantageous, and owing to the centrifugal force produced by the chip guide plate, no chips can enter the gap.

A third embodiment of the invention is characterized in that fixed vanes mounted in inclined position are provided in the annular interspace. Hereby the air is set in the desired internal rotary motion.

The invention is described in the following with the aid of an example, reference being made to the drawing attached, which presents a shaver in sectional view.

The shaver consists of a rotor 2 provided with a chip guide plate 1 and circumferential blades 3 around it. Outside and below the blade circle 3, there is an annular interspace 4 for the shavings cut from the chips. The shavings depart further through the discharge aperture 5 communicating with the interspace 4. Annular air passages 6,7 have been provided in the lower part of the interspace 4 and in the chip guide plate 1 of the rotor 2, through which the airflow created by the rotor can join the circulation as indicated by the arrow 8. The air passage 6 of the interspace 4 is formed by the gap between the inner wall 9 of the interspace and the expeller plate 10 of the shaver connected with the rotor and rotating therewith therebelow. The air passage 7 of the rotor 2 is formed by the gap between two stepwise superposed chip guide plates 1. In the interspace 4, fixed vanes 11 mounted in inclined position have been provided.

The chips entering the shaver are directed by the aid of the centrifugal force created by the chip guide plate 1 to the periphery 2 of the rotor and from there directed toward the circumferential blades 3 where they are cut into shavings on the circumferential blades 3. The shavings enter the interspace 4 underneath, departing therefrom further, owing to the centrifugal force created by the chip expeller plate 10, through the discharge aperture 5. The air set in motion by the rotor 2 is recycled as indicated by the arrow 8. Owing to the invention, there is no need for big blowers and a cyclone to remove and purify large quantities of air, which has been indispensable in shavers of prior art.

It is obvious to a person skilled in the art that various embodiments of the invention may vary within the scope of the claims stated below.

I claim:

1. Wood chip shaver comprising a rotor, a chip guide plate on said rotor, circumferential blades disposed around the outside of said rotor, an annular interspace formed outside and below said circumferential blades to receive shavings cut from wood chips, a discharge aperture communicating with said annular interspace through which the shavings leave said interspace, and at least one air passage provided on the margin of said interspace and in the chip guide plate of the rotor through which an air flow created by the rotor can rejoin circulation in the shaver.

2. Shaver according to claim 1, wherein the air passage of the interspace consists of a gap between an inner wall of the interspace and a shavings expeller plate connected with the rotor and rotating underneath the interspace.

3. Shaver according to claim 1, wherein the chip guide plate comprises two stepwise superposed plates and the air passage in the chip guide plate consists of a gap between the two stepwise superposed chip guide plates.

4. Shaver according to claim 1, wherein fixed vanes mounted in inclined position are provided in the interspace.

* * * * *